United States Patent [19]

Kunberger et al.

[11] 4,308,628

[45] Jan. 5, 1982

[54] ICE TOOL FOR MOUNTAINEERING

[76] Inventors: Walter R. A. Kunberger; Wyatt Ball, both of 669 Wilshire Pl., Newbury Park, Calif. 91320

[21] Appl. No.: 69,095

[22] Filed: Aug. 23, 1979

[51] Int. Cl.[3] ..... B25D 1/04

[52] U.S. Cl. ..... 7/145; 7/169

[58] Field of Search ..... 7/145–147, 7/169; 248/216.1, 217.1

[56] References Cited

U.S. PATENT DOCUMENTS

| | | | |
|---|---|---|---|
| 850,662 | 4/1907 | Lorenz | 248/216.1 X |
| 1,279,416 | 9/1918 | Osborne | 248/217.1 X |
| 1,613,729 | 1/1927 | Shearwood | 7/147 |
| 3,705,430 | 12/1972 | Ziaylek, Jr. | 7/147 |
| 3,735,434 | 5/1973 | Penberthy | 7/145 X |
| 4,030,150 | 6/1977 | Fisher | 7/145 |

*Primary Examiner*—James G. Smith
*Attorney, Agent, or Firm*—Dowrey & Cross

[57] ABSTRACT

Ice tool with a handle formed from the shaft providing clearance for the user's hand when the shaft is parallel and adjacent to an ice surface. The tool having a pick and spike for imbedding in the ice surface and a means for attachment of a line. A force supplied to the line further imbeds the pick and spike into the ice surface.

3 Claims, 6 Drawing Figures

ICE TOOL FOR MOUNTAINEERING

BACKGROUND OF THE INVENTION

This invention relates to mountaineering equipment. More particularly, this invention relates to mountaineering equipment for technical ice climbing with still greater particularlity to ice tools for technical ice climbing.

The earliest hand held implement used in ice climbing in early European history was a steel tipped staff or alpinstock and a woodcutter's axe used to form steps in the ice. In the 19th century the hatchet was merged with the alpinstock to form the ancestor of the alpine ice axe. Contemporary climbing methods have their genesis with the development of the ice axe and knowledge of proper use of the rope.

The alpine ice axe is comprised of an elongated shaft with a metal spike at one end. The metal spike functions in the manner of the staff with the metal point acting as a third point of contact with the ice and may function as an anchor for belays. The other end of the ice axe is called the head. The head of the ice axe has two primary parts a pick and an adz. The first, a pick, may be used to cut steps and/or may act as a means of support on the ice. The pick of the ice axe is also used to prevent a climber from sliding a long distance down a snow or ice slope by a technique called self-arrest.

Self-arrest is an important safety measure used in climbing. A climber who slips on an ice or snow slope orients the body so that the feet are pointing down the slope and the climber is facing into the slope. The ice axe is held in front of the climber and with the pick end of the head buried into the snow. The pick of the axe is pressed into the snow and the resulting force of pulling the pick through the snow slows the climber's rate of descent and eventually allows the climber to stop.

The other portion of the head of an ice axe is called the adz. In the earliest ice axes the adz of the ice axe was similar to that of a hatchet blade. The blade of the ice axe was then turned perpendicular to the staff to aid in step cutting. The adz of the ice axe is used primarily in cutting steps in soft snow. In current techniques of ice climbing it is not necessary to cut steps as the climber wears crampons which consist of a plurality of metal points attached to each foot. With the advent of the use of crampons step cutting is now generally used in situations where either the climber does not have crampons or is aiding less experienced climbers.

The staff or handle of the ice axe has undergone a gradual reduction in length as progressively steeper slopes are attempted. The alpinstock was often as long as two meters when used as a staff when walking on consolidated snow. The early ice axe was approximately one meter in length and could be used as a cane on moderate slopes. In 1908 Oscar Ecknestein developed the ten point crampon and a lightweight ice axe 86 centimeters in length. The shorter length of the Eckenstein ice axe allowed use of the ice axe as a hand tool to provide an additional point of connection to the ice slope. The length of the ice axe was eventually reduced to as little as 55 centimeters and the pick curved to provide stronger attachment to the mountain.

With the shortening of the handle of the ice axe and the lack of a need for step cutting ability, the adz has been eliminated on many designs. The first of these designs were the so-called ice hammer, or north wall hammer, wherein the adz is replaced by a hammer head for use in attaching pitons to the ice or rock in mixed climbs. The ice hammer was popular primarily in Europe. From this beginning many varieties of ice tools have been invented. Current ice climbing techniques call for one tool in each hand and crampons having forward pointing points on each foot.

The simplest ice tool is a handle with a single spike resembling a heavy duty ice pick. This tool is commonly called an ice dagger. Climbers generally prefer a tool having a curved or angled pick such as is found on a short ice axe or ice hammer, however. The current ice tool thus consists of a shaft having a spike at one end, a relatively short shaft and a curved pick. The other end of the head may be either an adz or a hammer.

In climbing ice, two basic varieties of technique are used. The first technique is called the French technique wherein the climber attempts to keep his feet parallel to the surface of the ice with crampons and carries at least one ice tool for providing a third means of support. The spike of an ice axe is often used. On extremely steep ice the climber turns so that he is facing the ice and supports himself on the front points of the crampons and carries an ice tool in each hand for providing an additional point of support. In extremely steep climbing the French method thus becomes similar to the so-called German or Austrian method wherein the climber faces into the slope continually and supports his weight on the front points of the crampons. An ice tool which may be a short ice axe or ice hammer is carried in each hand. For a more complete description of the technique and terminology of technical ice climbing reference is made to *Climbing Ice* by Yvon Chouinard published by Sierra Club Books, copyright 1978.

A problem with current ice tools is that when the pick is embedded into the ice the handle is necessarily adjacent to the ice. The proximity of the handle to the ice makes it difficult for the climber to grip the handle of the hammer when the pick is in its most effective holding position. As a result, climbers must often place the pick at an angle to provide sufficient clearance for gripping the handle, reducing the holding strength of the pick. This problem was recognized by noted ice climber Jeff Lowe in his book *The Ice Experience,* published by Book Developers, Inc. © 1979 wherein he stated:

"A Note from the Doctor for Terrordactyl Knuckle or Hummer Bummers

"If you have been practicing what has been preached in the last few paragraphs, you will no doubt already have experienced the initial symptoms of one of these recent additions to the vocabulary of human deformity. The problem stems from the tendency to place the tools with their shafts right against the ice and consequently bash your knuckles. Once you've bruised them, you'll be likely to continue the damage until you give them a rest cure. Better than that, however, is prevention. Unfortunately, total prevention is not possible unless you feel like wearing some sort of steel handguard as you climb. But if that makes you feel too much like a knight in shining armor, there is something you can do: learn to use your tools so that the shaft ends up close to the ice but not hard against it upon completion of the swing. It's a more subtle skill than one might first imagine and one well worth perfecting."

Current designs also do not frequently provide sufficient gripping strength in snow that is not completely consolidated or in weak ice. Accordingly, a need has arisen for an ice axe having increased gripping strength and providing both clearance and maximum holding strength.

SUMMARY OF THE INVENTION

An improved ice tool is provided by the present invention having a downwardly sloping pick at one end of a handle and a second downwardly sloping spike at the other end of the handle. The handle is configured in such a way as to provide clearance for the hand when the points of the tool are imbedded into a slope. A means of attachment of a rope or sling is provided in such a manner that downward force on said means of attachment results in digging the pick and spike of the tool deeper into the ice providing a sound anchor. The pick of the axe may be any of a number of designs dependent upon the individual climber's preference.

DESCRIPTION OF THE PREFERRED EMBODIMENT

Figure 1:
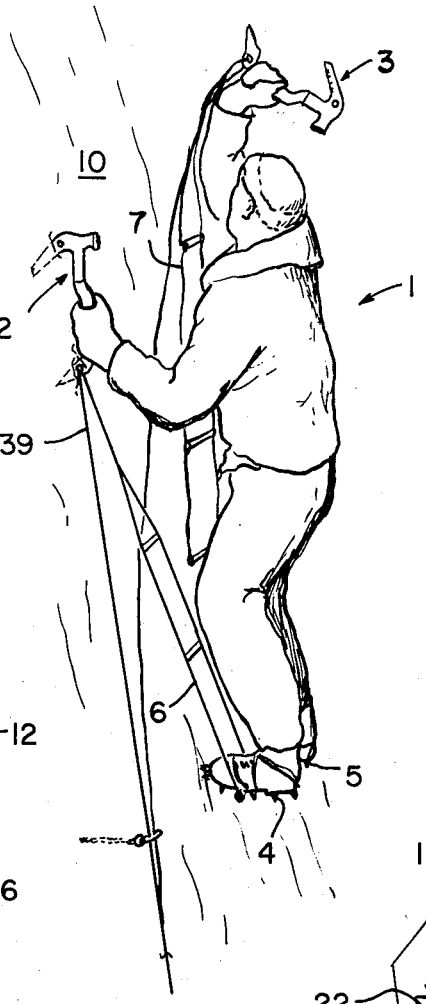
FIG. 1 is an illustration of an embodiment of the invention in a working environment.
Figure 4:
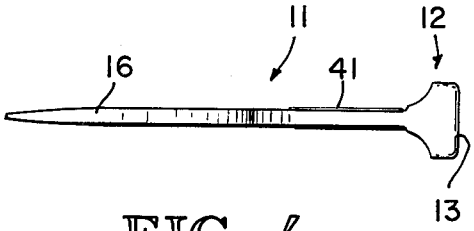
FIG. 4 is a top plan view of the FIG. 1 tool.
Figure 3:
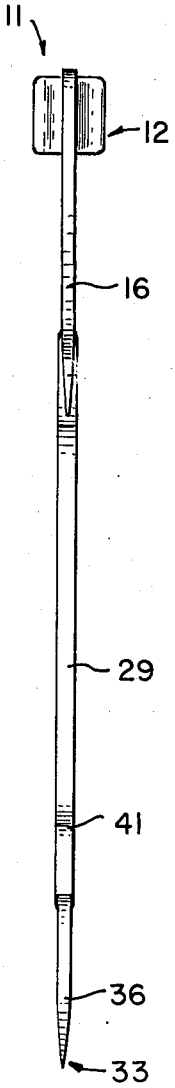
FIG. 3 is an end elevational view of the FIG. 1 tool.

FIG. 1 illustrates the use of the ice tool by a climber. Climber 1 carries an ice tool 2, 3 in each hand and has crampons 4, 5 attached to each foot. On steep ice slopes such as the slope 10 each crampon has at least two forwardly directed points. The climber proceeds upward by alternately kicking his legs with attached crampons into the snow or ice wall 10. After each upward step, ice tools 2, 3 are placed into the slope 10 above. In extremely severe conditions, it may be necessary to hang webbing slings 6, 7 from the ice tools for the attachment of stirrups to be used by the climber as illustrated if it is not possible to obtain traction on the ice with the crampons.

In beginning a steep ice climb the procedure is as follows: First, one of the ice tools 2 is planted into the ice slope 10 just above shoulder level. The climber then plants the second ice tool 3 into slope 10 at a distance sufficiently far from the first planted ice tool 2 so that the ice between the tools 2 and 3 does not break out. Climber 1 thus obtains a point of balance from the implanted ice tools 2, 3. Using the balance obtained, the climber first stands on one crampon 4 and then the other 5. On extremely brittle or smooth ice slopes it is required that the climber kick the forward facing points of the crampons 4, 5 into slope 10. The climber then advances up the wall moving one point of contact with the slope at a time. The ice tools 2, 3 must both be readily insertable and removable into the ice yet provide a strong contact with the ice.

A variant on the above technique utilizes slings 6, 7 attached to holes in the ice tools 2, 3. The climber first places one ice tool 2 and stands in the sling 6. Under some conditions the climber would also be relying on the forward facing points of crampons 4, 5 for additional support. The climber then places the other tool 3 and climbs into the sling 7 on the second tool 3. The first tool 2 is then removed from slope 10 and placed above and the process repeated. This process allows the climbing of extreme ice slopes with a lower degree of effort.

Figure 2:
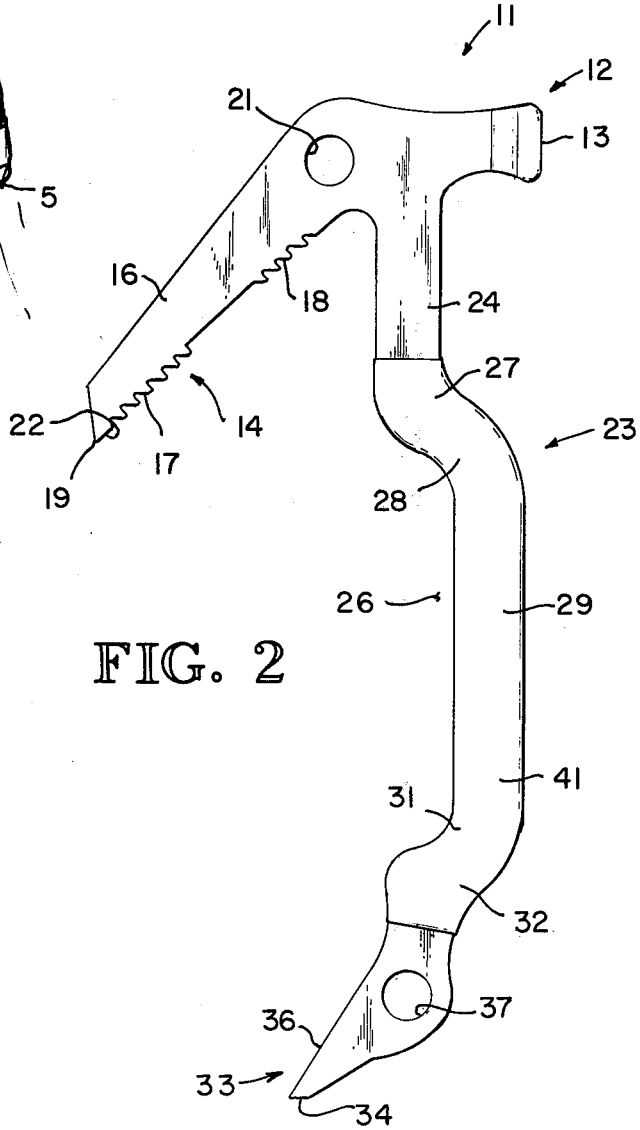
FIG. 2 is a side elevational view of one embodiment of the invention.
Figure 6:
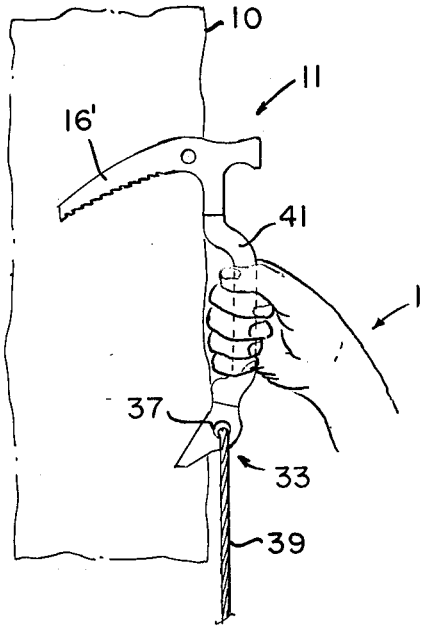
FIG. 6 illustrates the invention's use on an ice surface.

FIG. 2 is a side view of one embodiment of the invention constructed of a single piece of steel. Other materials are possible and may be used by a person skilled in the art. One end of the tool comprises the head indicated generally 11. In this embodiment head 11 serves at least two functions. The first end 12 of the head is a hammer head 13 which may be used to aid in the insertion of ice pitons into ice or for hammering rock pitons into a crack if rock slopes are encountered on the climb. The second end 14 of head 11 is of fundamental importance in an ice tool. End 14 of the tool comprises the pick 16. In this embodiment pick 16 is an inclined member having a first and a second set of teeth 17 and 18 respectively which aid in gripping the ice upon movement of pick 16. The first set of teeth 17 are at the terminal or outer end of the pick and the second set of teeth 18 are near the center of pick 16. With this arrangement of teeth 18 aid in gripping the outer end of the hole formed by insertion of the pick. The extreme end of pick 16 includes a sharp point 19 to aid in the insertion of the pick into the ice slope. The inner end of pick 16 is provided with a hole 21 which in this embodiment is preferably about $\frac{5}{8}$th of an inch in diameter. Hole 21 allows insertion of a carabiner or sling (not shown) for use in aid climbing. In this embodiment the lower surface or face 22 of the pick 16 is inclined at an angle of approximately 47° to the general longitudinal axis of the shaft 23. This amount of angle has been found satisfactory for climbing under the majority of conditions but may be modified by a person skilled in the art for special circumstances. In this embodiment shaft 23 of the axe is configured as shown. The shaft 23 begins with a section 24 perpendicular to head 11 then is offset as at 26 by an amount sufficient to provide clearance for the hand when the pick is buried entirely in the ice surface. In this embodiment section 24 of the shaft is approximately one and $\frac{3}{4}$ inches long followed by a first and second bend 27 and 28 respectively totalling approximately one and $\frac{5}{8}$ inches. The remaining portion of the shaft includes a straight section 29 of approximately four inches which forms the handle, a third bend 31 of approximately one and $\frac{1}{8}$ inches in length and a straight section 32 with a length of approximately $\frac{3}{4}$ of an inch. The straight section 29 must of course be sufficiently long to allow the climber to insert all fingers. A spike 33 is fixed to the end of the shaft opposite the head 11, and as seen in FIG. 2 is inclined at an angle of approximately 60° to the general longitudinal axis of the shaft 23 on its bottom edge 34 and approximately 30° from the axis of the shaft on its top edge 36. Spike 33 is provided with a sharp point 34 to aid in gripping the ice thus significantly increasing the holding strength of the tool. Spike 33 is also provided with an attachment means in the form of a hole 37 for a line. The hole 37 may be approximately $\frac{5}{8}$ an inch in diameter and allows for attachment of a line 38 as illustrated in FIG. 6 which may be either a stirrup or a sling. Attachment of a stirrup 6 such as the stirrup shown in FIG. 1 allows the tool to be used in aid climbing upon insertion of the climber's foot. Attachment means 37 is so placed that a downward pull on line 39 attached to the tool results in inserting pick 16 and spike 33 of the tool more deeply into the ice.

Figure 5:
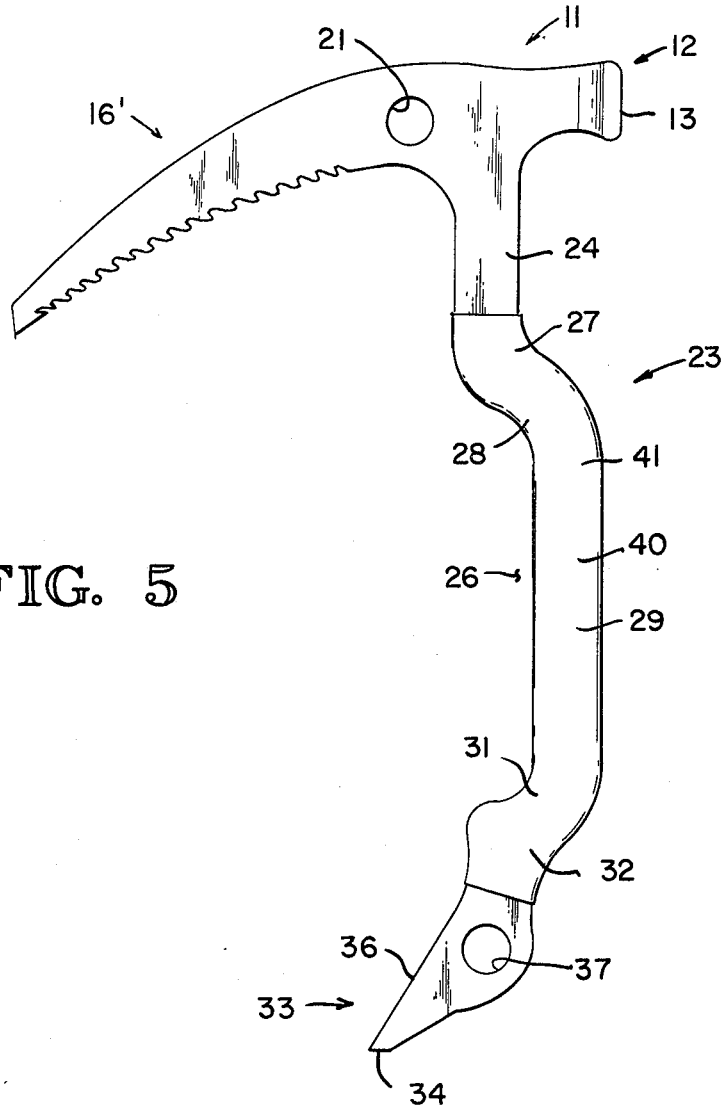
FIG. 5 is a side elevational view of a second embodiment of the invention.

FIG. 5 shows a second embodiment of the invention wherein the tool is identical to that of the FIG. 2 embodiment with the exception of the pick 16'. In this embodiment pick 16' is curved or arcuate rather than being inclined as in FIG. 2, with the curve of pick 16' being chosen to match the natural swinging radius of the climber's arm. The technique used with this tool is similar to that used with the FIG. 2 embodiment. The FIG. 5 embodiment also includes a pick tooth arrangement wherein the teeth extend over substantially the entire length of the curved bottom surface of the pick.

FIG. 6 illustrates the working position of the tool, imbedded into ice slope 10. As is apparent from this illustration, shaft 23 provides a handle 40 for the climber to grasp and allows pick 16' to be driven more deeply into the ice slope 10 while still allowing the climber to grip the tool. An insulating layer of material 41 is added to cover the handle portion 40 of the tool. The insulating material 41 both insulates the climber from the metal tool and provides a less slippery surface to grasp.

Although the present invention has been described with reference to a particular embodiment thereof, it will be understood by those skilled in the art that numerous modifications may be made without departing from the scope of the invention. Accordingly, all modifications and equivalents may be resorted to which fall within the scope of the invention as claimed.

What is claimed is:

1. A climbing tool comprising;

an elongated shaft having clearance means for providing clearance for the user's hand when said shaft is parallel and engaged with a climbing surface, head means at one end of said shaft for attaching said tool to said surface, and line attachment means operatively associated with said shaft for attaching a line to said shaft.

2. A climbing tool comprising;

an elongated shaft having clearance means for providing clearance for the user's hand when said shaft is parallel and engaged with a climbing surface, a pick at one end of said shaft for attaching said tool to said surface, and aid sling attachment means operatively associated with said shaft for converting a downward force on said sling to an imbedding force on said pick.

3. A climbing tool comprising;

an elongated shaft with a first end and a second end having a handle portion displaced from the line joining the first and second ends for providing a surface for the user's hand to grip, a spike attached to the first end of said shaft for providing a first point of attachment to a climbing surface, a pick attached to the second end of said shaft for providing a second point of attachment to said climbing surface, and a hammer head attached to said shaft for hammering objects into the climbing surface.

* * * * *